US006706982B1

(12) United States Patent
Knopp

(10) Patent No.: US 6,706,982 B1
(45) Date of Patent: Mar. 16, 2004

(54) STRUCTURAL SET FOR SWITCH CONSOLES FOR HOUSEHOLD APPLIANCES WITH CABINET-SHAPED HOUSINGS

(75) Inventor: Lothar Knopp, Berlin (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 648 days.

(21) Appl. No.: 09/154,485

(22) Filed: Sep. 16, 1998

(30) Foreign Application Priority Data

Sep. 16, 1997 (DE) ..... 197 40 705

(51) Int. Cl.[7] ..... D03F 33/00
(52) U.S. Cl. ..... 200/296; 248/27.1
(58) Field of Search ..... 248/27.1, 207, 248/558, 645; 200/296

(56) References Cited

U.S. PATENT DOCUMENTS 2,974,918 A * 3/1961 Voigtlander ..... 248/558 X
4,132,877 A * 1/1979 Daigle ..... 200/296
4,798,424 A * 1/1989 Coates et al. ..... 248/558 X
5,200,884 A * 4/1993 Ohashi ..... 200/296 X
5,350,140 A * 9/1994 Ripley et al. ..... 248/27.1

FOREIGN PATENT DOCUMENTS

DE 35 42 503 A1 6/1987

OTHER PUBLICATIONS

Vittorio Ferretti: "Dictionary of Electronics, Computing and Telecommunications" p. 385—undated.

* cited by examiner

*Primary Examiner*—Renee Luebke
(74) *Attorney, Agent, or Firm*—Laurence A. Greenberg; Werner H. Stemer; Ralph E. Locher

(57) ABSTRACT

A structural set having at least two different configurations of a control panel equipped with control elements organized differently from one another from right to left in mirrored symmetry. A standard carrier plate is mounted behind the control panel. The carrier plate receives at least one switching device actuable by one of the control elements of the different configurations of the control panel.

12 Claims, 1 Drawing Sheet

STRUCTURAL SET FOR SWITCH CONSOLES FOR HOUSEHOLD APPLIANCES WITH CABINET-SHAPED HOUSINGS

BACKGROUND OF THE INVENTION

Field of the Invention

The invention relates to a structural set for switch consoles for household appliances with cabinet-shaped housings, especially for washing machines and laundry dryers with at least two types of control panels having control elements organized differently from right to left and with identical printed circuit boards. The identical carrier plates are provided for mounting behind each of the different types of control panels. The printed circuit boards each have at least one switching device actuable by one of the control elements.

Such a switch console is known from Published, Non-Prosecuted German Patent Application DE 35 42 503 A1. Several control elements in the form of rotary switches and buttons are disposed therein, by which different program inputs for a program-controlled household appliance, for example a washing machine, can be accomplished. Such switch consoles have, behind the outwardly visible control panel, a carrier plate on which corresponding switching devices for the control elements and indicator elements are mounted.

In a program for manufacturing different series of household appliances of one type, for example of washing machines, the appliances will be equipped with control panels that visually differ significantly. The known mode of construction of the switch consoles requires correspondingly different printed circuit boards for the switching devices and indicator elements.

SUMMARY OF THE INVENTION

It is accordingly an object of the invention to provide a structural set for switch consoles for household appliances with cabinet-shaped housings which overcomes the above-mentioned disadvantages of the prior art devices of this general type, which minimizes the number of individual components for the switch console structural sets for forming at least two types of switch consoles for different series of household appliances, so that cost efficiency is achieved by standardization of individual components.

With the foregoing and other objects in view there is provided, in accordance with the invention, in a multiplicity of household appliances having cabinet-shaped housings and consoles, a structural set for the switch consoles, including: at least two different types of control panels including a first control panel and a second control panel each having control elements configured differently from right to left; a plurality of identical printed circuit boards to be mounted behind each of the at least two different types of control panels; a switching device mounted on each of the identical printed circuit boards and actuated by one of the control elements; and the control elements of the first control panel having a configuration organized in a substantially mirror-symmetrical pattern relative to a configuration of the control elements of the second control panel.

According to the invention, the object is met in that only one type of printed circuit boards is necessary for the structural set having a control panel capable of being configured in two separate configurations. The organization of the control elements of the two configurations of the control panel is at least approximately in mirror symmetry relative to one another.

The solution according to the invention provides for a control panel having two separate configurations with different appearances based on a single type of printed circuit boards. The carrier plate is disposed behind the control panel in one position for a first configuration and behind the control panel in a position which is rotated, for example, through 180° (rotationally symmetrical) for a second configuration. A different organization of the sequence of control elements provided on the control panel thereby results in two configurations for the control panel.

In the case of a structural set with a control element disposed eccentrically in the control panel it is of particular advantage in the sense of the foregoing objective if in one configuration of the control panel the rotary element is disposed to the right of center and in the other configuration to the left of center. The appearances of the two configurations of the control elements differ most strongly in that an optically conspicuous control element is disposed at a visually distinctly different place than in the other configuration of the control panel.

Further variations in the appearance of the control panel can be advantageously achieved by a further development of the invention in which still further switching devices are disposed on the printed circuit boards. The control elements (buttons, rotary switches) ?are organized in one installation position of the printed circuit boards in a sequence organized from right to left for the one configuration of the control panel and for the other configuration, with the printed circuit boards installed after rotation, for example from left to right in the same sequence.

In accordance with an added feature of the invention, there are further switching devices mounted on each of the identical printed circuit boards, a respective one of the control elements actuating a respective one of the further switching devices, the control elements organized in a sequence from right to left in the first control panel operable with the identical printed circuit boards in a first installation position, the control elements organized in a sequence from left to right in the second control panel operable with the identical printed circuit boards in a second installation position rotated 180° relative to the first installation position.

In accordance with an additional feature of the invention, there are at least two sets of indicator elements mounted on each of the identical printed circuit boards, one of the at least two sets of indicator elements disposed behind respective control elements in a first installation position of the identical printed circuit boards, another of the at least two sets of indicator elements disposed behind the respective control elements in a second installation position rotated about 180° relative to the first installation position of the identical printed circuit boards.

In accordance with another feature of the invention, there are illuminating means disposed on each of the identical printed circuit boards, and some of the control elements having coaxial optical conductors with light entry surfaces directed in front of the illuminating means.

With the foregoing and other objects in view there is provided, in accordance with the invention, in a multiplicity of household appliances having cabinet-shaped housings, switch consoles, and at least two different types of control panels including a first control panel and a second control panel each having control elements configured differently from right to left, a structural set for the switch consoles, including: a plurality of identical printed circuit boards to be mounted behind each of the at least two different types of control panels; a switching device mounted on each of the identical printed circuit boards and actuated by one of the control elements; and the control elements in the first control panel having a configuration organized in a substantially mirror-symmetrical pattern relative to a configuration of the control elements of the second control panel, the plurality of identical printed circuit boards configured to function with the configuration of the first control panel and the second control panel.

In accordance with a concomitant feature of the invention, one of the control elements is a rotary element disposed eccentrically in each of the at least two different types of control panels, the rotary element disposed in a right-of-center position in the first control panel and the rotary element disposed in a left-of-center position in the second control panel, the switching device mounted in each of the identical printed circuit boards actuated by the rotary element in the first control panel and the second control panel.

Other features which are considered as characteristic for the invention are set forth in the appended claims.

Although the invention is illustrated and described herein as embodied in a structural set for switch consoles for household appliances with cabinet-shaped housings, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
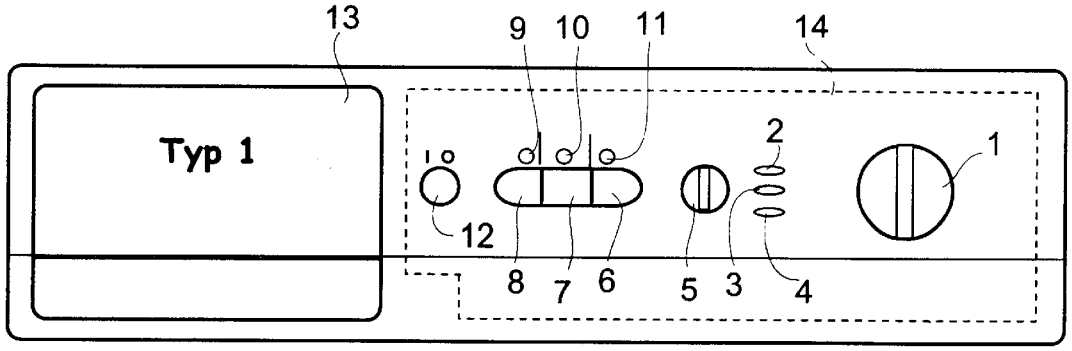
FIG. 1 is a front elevational view of a front surface a first control panel for a washing machine series of a manufacturer.

Referring now to the figures of the drawing in detail and first, particularly, to FIG. 1 thereof, there is shown a control panel containing, on its front surface from right to left a rotary switch 1, three optical indicator elements 2, 3 and 4 disposed one above the other, a further rotary switch 5, three buttons 6, 7 and 8 disposed next to one another with associated optical indicator elements 9, 10 and 11, and a pushbutton switch 12 for switching in a voltage.

Figure 2:
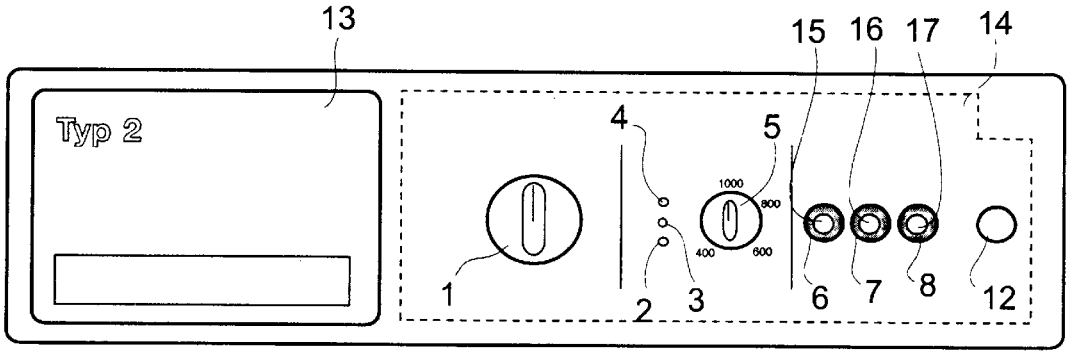
FIG. 2 is a front elevational view of the front surface of a second control panel for another washing machine series of the manufacturer.

In the case of the control panel illustrated in FIG. 2 the same series of control elements is organized from left to right. Moreover, the two control panels each contain a grip plate 13 for a washing agent drawer disposed therebehind.

A printed circuit board 14 disposed behind the control panel of FIG. 1 is indicated by dashed lines. Corresponding switching and indicator devices are mounted on the printed circuit board 14 behind the control elements 1, 5 to 8 and 12 of the control panel. In similar manner the printed circuit board 14 is mounted behind the control panel of FIG. 2, only with the difference that the printed circuit board 14 in FIG. 2 is installed rotated exactly through 180° relative to that in FIG. 1 (rotationally symmetrical). The indicator elements 2 to 4 considered from above to below are thereby found in reverse sequence, which can be intended. If, however, the original sequence is to be maintained or actually to be rearranged, the indicator elements, moreover the control elements (for example the buttons) as well, if desired, can be reorganized by software adaptation.

The sequence of the switching and indicator devices disposed on the printed circuit boards 14 or the control elements disposed on the control panels basically has no significance for the invention. Equally of no significance are the number of different types of control elements and the spacings relative to one another. In departure from the illustrated embodiments, however, one of the rotary switches 1 and 5, for example, can also be disposed exactly in the inverting rotational center point of the plate or the corresponding area of the control panel, so that this very control element is always disposed in the middle in both types of control panel. On the other hand, however, additional different appearances can also arise in that the printed circuit boards 14 in one case are disposed particularly far to the right behind the control panel and in the other case particularly far to the left. A sufficiently significantly different appearance of the two types of control panels is decisive for fulfillment of the object according to the invention.

Within the scope of the present invention a possible further variation of the configuration of the control and/or the indicator elements can consist in that microswitches, that are mounted on the printed circuit board 14 as control buttons are disposed, even after rotation of the plate, at the corresponding opposite positions. But the control buttons are installed at a position slightly deviating therefrom in the control panel and the microswitches are nevertheless reached by an actuating bridge (not illustrated) lying behind the control panel. The mirror symmetry is thereby to be referred only to the sequence of the configuration of the control elements. The at least approximate mirror symmetry can, however, also be retained if the printed circuit board 14 is installed turned through an angle other than 180°, for example through 90°.

Obviously its original transverse dimension should then not be greater than the new height dimension.

Moreover and as illustrated in FIG. 2, for example, similarly only approximately in mirror symmetry, further variants can be formed in that luminescent diodes, which are associated with specific buttons, such as for example the luminescent diodes 9 to 11 in FIG. 1, after the rotation of the printed circuit board come to lie not under the corresponding control buttons of the changed control panel, but, either through a fittings variant of the printed circuit board 14 or by a carrier plate 14 previously equipped in redundancy mode with two sets of luminescent diodes, are disposed at the corresponding offset position again above the buttons. In the last-mentioned form of fitment of the printed circuit board 14, the doubled configuration of luminescent diode sets can possibly be cheaper than different fitment variants thereof. In fact, in principle too many luminescent diodes are then switched on (at least two, even though only one should be lit up), but the radiation from luminescent diodes into the darkness behind the control panel is harmless.

A modification is, however, also possible in that as in FIG. 2 optical conductors 15 to 17 are incorporated in the buttons 6 to 8. The light entry surfaces of the optical conductors 15 to 17 are faced towards the luminescent diodes disposed on the printed circuit board 14, possibly even disposed near the buttons.

I claim:

1. In a multiplicity of household appliances having cabinet-shaped housings and switch consoles, a structural set for the switch consoles, comprising:

at least two different types of control panels including a first control panel and a second control panel each having control elements configured differently from right to left;

a plurality of identical printed circuit boards to be mounted behind each of said at least two different types of control panels;

a switching device mounted on each of said identical printed circuit boards and actuated by one of said control elements;

said control elements of said first control panel having a configuration organized in a substantially mirror-symmetrical pattern relative to a configuration of said control elements of said second control panel; and at least two sets of indicator elements mounted on each of said identical printed circuit boards, one of said at least two sets of indicator elements disposed behind respective control elements in a first installation position of said identical printed circuit boards, another of said at least two sets of indicator elements disposed behind said respective control elements in a second installation position of said identical printed circuit boards rotated about 180° relative to said first installation position.

2. The structural set according to claim 1, wherein one of said control elements is a rotary element disposed eccentrically in each of said at least two different types of control panels, said rotary element disposed in a right-of-center position in said first control panel and said rotary element disposed in a left-of-center position in said second control panel.

3. The structural set according to claim 1, including further switching devices mounted on each of said identical printed circuit boards, a respective one of said control elements actuating a respective one of said further switching devices, said control elements organized in a sequence from right to left in said first control panel operable with one of said identical printed circuit boards in a first installation position, said control elements organized in a sequence from left to right in said second control panel operable with another of said identical printed circuit boards in a second installation position rotated 180° relative to said first installation position.

4. In a multiplicity of household appliances having cabinet-shaped housings, switch consoles, and at least two different types of control panels including a first control panel and a second control panel each having control elements configured differently from right to left, a structural set for the switch consoles, comprising: a plurality of identical printed circuit boards to be mounted behind each of the at least two different types of control panels;

a switching device mounted on each of said identical printed circuit boards and actuated by one of the control elements;

the control elements in the first control panel having a configuration organized in a substantially mirror-symmetrical pattern relative to a configuration of the control elements of the second control panel, said plurality of identical printed circuit boards configured to function with the configuration of the first control panel and the second control panel; and at least two sets of indicator elements mounted on each of said identical printed circuit boards, one of said at least two sets of indicator elements disposed behind respective control elements in a first installation position of said identical printed circuit boards, another of said at least two sets of indicator elements disposed behind the respective control elements in a second installation position of said identical printed circuit boards rotated about 180° relative to said first installation position.

5. The structural set according to claim 4, wherein one of the control elements is a rotary element disposed eccentrically in each of the at least two different types of control panels, the rotary element disposed in a right-of-center position in the first control panel and the rotary element disposed in a left-of-center position in the second control panel, said switching device mounted in each of said identical printed circuit boards actuated by the rotary element in the first control panel and the second control panel.

6. The structural set according to claim 4, including further switching devices mounted on each of said identical printed circuit boards, a respective one of the control elements actuating a respective one of said further switching devices, the control elements organized in a sequence from right to left in the first control panel operable with one of said identical printed circuit boards in a first installation position, the control elements organized in a sequence from left to right in the second control panel operable with another of said identical printed circuit boards in a second installation position rotated about 180° relative to said first installation position.

7. In a multiplicity of household appliances having cabinet-shaped housings and switch consoles, a structural set for the switch consoles, comprising:

at least two different types of control panels including a first control panel and a second control panel each having control elements configured differently from right to left;

a plurality of identical printed circuit boards to be mounted behind each of said at least two different types of control panels;

a switching device mounted on each of said identical printed circuit boards and actuated by one of said control elements;

said control elements of said first control panel having a configuration organized in a substantially mirror-symmetrical pattern relative to a configuration of said control elements of said second control panel; and illuminating means disposed on each of said identical printed circuit boards, some of said control elements having coaxial optical conductors with light entry surfaces directed in front of said illuminating means.

8. The structural set according to claim 7, wherein one of said control elements is a rotary element disposed eccentrically in each of said at least two different types of control panels, said rotary element disposed in a right-of-center position in said first control panel and said rotary element disposed in a left-of-center position in said second control panel.

9. The structural set according to claim 7, including further switching devices mounted on each of said identical printed circuit boards, a respective one of said control elements actuating a respective one of said further switching devices, said control elements organized in a sequence from right to left in said first control panel operable with one of said identical printed circuit boards in a first installation position, said control elements organized in a sequence from left to right in said second control panel operable with another of said identical printed circuit boards in a second installation position rotated 180° relative to said first installation position.

10. In a multiplicity of household appliances having cabinet-shaped housings, switch consoles, and at least two different types of control panels including a first control panel and a second control panel each having control elements configured differently from right to left, a structural set for the switch consoles, comprising:

a plurality of identical printed circuit boards to be mounted behind each of the at least two different types of control panels;

a switching device mounted on each of said identical printed circuit boards and actuated by one of the control elements;

the control elements in the first control panel having a configuration organized in a substantially mirror-symmetrical pattern relative to a configuration of the control elements of the second control panel, said plurality of identical printed circuit boards configured to function with the configuration of the first control panel and the second control panel; and illuminating means disposed on each of said identical printed circuit boards, some of the control elements having coaxial optical conductors with light entry surfaces directed in front of said illuminating means.

11. The structural set according to claim 10, wherein one of the control elements is a rotary element disposed eccentrically in each of the at least two different types of control panels, the rotary element disposed in a right-of-center position in the first control panel and the rotary element disposed in a left-of-center position in the second control panel, said switching device mounted in each of said identical printed circuit boards actuated by the rotary element in the first control panel and the second control panel.

12. The structural set according to claim 10, including further switching devices mounted on each of said identical printed circuit boards, a respective one of the control elements actuating a respective one of said further switching devices, the control elements organized in a sequence from right to left in the first control panel operable with one of said identical printed circuit boards in a first installation position, the control elements organized in a sequence from left to right in the second control panel operable with another of said identical printed circuit boards in a second installation position rotated about 180° relative to said first installation position.

* * * * *